US008651892B2

(12) United States Patent
Arant

(10) Patent No.: US 8,651,892 B2
(45) Date of Patent: Feb. 18, 2014

(54) VISUAL MATING DETECTOR FOR ELECTRICAL CONNECTOR

(75) Inventor: Michael Paul Arant, Fenton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 37 days.

(21) Appl. No.: 13/419,436

(22) Filed: Mar. 14, 2012

(65) Prior Publication Data

US 2013/0244474 A1 Sep. 19, 2013

(51) Int. Cl.
*H01R 3/00* (2006.01)

(52) U.S. Cl.
USPC ..... 439/489; 439/910

(58) Field of Classification Search
USPC ..... 439/489, 910
See application file for complete search history.

(56) References Cited

U.S. PATENT DOCUMENTS

| | | | | | |
|---|---|---|---|---|---|
| 2,610,996 | A * | 9/1952 | Rickabaugh | 439/713 |
| 2,892,991 | A * | 6/1959 | Beebee et al. | 439/319 |
| 3,229,242 | A * | 1/1966 | Finney et al. | 439/679 |
| 3,445,805 | A * | 5/1969 | McLoad | 439/277 |
| 3,611,247 | A * | 10/1971 | Adams et al. | 439/106 |
| 3,649,839 | A * | 3/1972 | Appleton | 250/215 |
| 3,855,569 | A * | 12/1974 | Tymkewicz | 439/695 |
| 4,902,244 | A * | 2/1990 | Endo et al. | 439/489 |
| 4,915,648 | A * | 4/1990 | Takase et al. | 439/490 |
| 5,120,255 | A * | 6/1992 | Kouda et al. | 439/489 |
| 5,345,520 | A * | 9/1994 | Grile | 385/15 |
| 5,556,287 | A * | 9/1996 | Kuhn et al. | 439/89 |
| 5,780,775 | A * | 7/1998 | Yu | 174/135 |
| 6,333,467 | B1 * | 12/2001 | Matsuo | 174/254 |
| 7,361,039 | B2 * | 4/2008 | Koehler | 439/207 |
| 7,497,723 | B2 * | 3/2009 | Brassell et al. | 439/489 |
| 7,607,923 | B2 * | 10/2009 | Jordan et al. | 439/67 |
| 7,963,782 | B2 * | 6/2011 | Hughes | 439/181 |
| 8,029,313 | B2 * | 10/2011 | Fendrock et al. | 439/489 |
| 8,142,220 | B2 * | 3/2012 | Burns | 439/488 |
| 8,235,292 | B2 * | 8/2012 | Talboys | 235/462.1 |
| 8,508,946 | B2 * | 8/2013 | Ching | 361/737 |
| 2001/0034156 | A1 * | 10/2001 | Yamane | 439/492 |
| 2004/0102104 | A1 * | 5/2004 | Kuroda et al. | 439/748 |

* cited by examiner

*Primary Examiner* — Neil Abrams
(74) *Attorney, Agent, or Firm* — Joseph E. Root

(57) ABSTRACT

The present disclosure describes a system for connecting two connectors to each other. The system includes a first connector having a first connector surface, and the first connector surface includes a transparent shape. Further, a second connector, having a second connector surface, includes a portion that includes a second connector color. Particularly, the second connector is configured to be inserted into the first connector, enabling a superimposition and alignment of the transparent shape with the portion of the second connector surface, thereby visually indicating a valid connection between the two connectors.

17 Claims, 1 Drawing Sheet

VISUAL MATING DETECTOR FOR ELECTRICAL CONNECTOR

BACKGROUND

This invention relates generally to connectors, and, more particularly, to a pair of connectors, having visual means to indicate a valid connection between them upon mating with each other.

In the field of wire harness assemblies and installations, a secure seating of all connectors therein, is required to confirm a valid connection. A poorly seated connector will result in an improper electrical connection, causing improper flow of energy, and, consequently, inappropriate functioning of related accessories or devices, such as audio devices, etc.

Attempts have been made over the years to ensure a proper connector seating during an assembly of such electrical components. Consequently, push-to-seat connectors and pull-to-seat connectors have been widely incorporated and employed in industrial applications, and, more particularly, during conventional assembly practices. Such connectors include connector-retaining clips that enable a positive engagement between a pair of connectors. Furthermore, the assembly operators involved primarily utilize a tactile and/or an audible feedback, obtained through clicking or snapping of the retaining clips, to confirm a valid connection between the connectors. Such connectors, however, suffer from redundant complexities, and the weight of the retaining clips also adds to the bulkiness of the system. More particularly, high insertion forces can be required to complete such connections, adding to increased energy requirements.

Moreover, bolt-driven fasteners and connectors, when applied, also require high insertion forces to confirm a valid connection. In particular, while seating a bolt-driven connector, care must be taken to prevent the bolt from being over tightened, as an over tightening may damage the desired connection. Certain digital systems are in place that display a tightening force applied over a connector, during a connector insertion. Such systems however, requiring a continuous energy back up, through portable batteries, etc., are not widely desired and employed.

Currently, there is no way of visually confirming a valid connection between two such electrical connectors. Such visual connections, improving upon the overall weight and simplicity of a valid connection system, also aim to lessen operator fatigue and discomfort. Accordingly, an electrical connection, that can be validated visually, is proposed in the present disclosure.

SUMMARY

The present disclosure provides a visual means for indicating whether an electric connector is fully connected or not. Although this embodiment is directed to electric connectors, the principles of the disclosure are equally applicable to other types of connectors, as well.

One embodiment of the present disclosure describes a system for connecting two connectors to each other. The system includes a first connector having a first connector surface, with the first connector surface including a transparent shape. Further, a second connector includes a portion on a second connector surface along with a second connector color. The second connector is configured to be inserted into the first connector, allowing a superimposition and an alignment of the transparent shape with the portion, thereby visually indicating a valid connection between the two connectors.

Another embodiment of the present disclosure describes a connecting system for electrical connectors. The system includes a female connector configured to include a first connector surface, wherein, the first connector surface is configured to include a transparent shape. Further, a male connector is configured to include a second connector surface, wherein, the second connector surface includes a portion, which in turn includes a second connector color. In particular, the male connector is adapted to mate with the female connector, allowing a superimposition and alignment of the transparent shape with the portion, thereby visually indicating a valid connection between the two connectors.

Certain embodiments of the present disclosure describe a method for visually indicating a connection between two electrical connectors. The method includes providing a first connector, having a first connector surface that includes a transparent shape configured in a predefined shape. The method further includes providing a second connector, having a second connector surface, with the second connector surface having a portion with a second connector color. Subsequently, mating the second connector with the first connector indicates a valid connection visually when the transparent shape and the portion are superimposed and aligned in relation to each other.

BRIEF DESCRIPTION OF THE DRAWINGS

The figures described below set out and illustrate a number of exemplary embodiments of the disclosure. Throughout the drawings, like reference numerals refer to identical or functionally similar elements. The drawings are illustrative in nature and are not drawn to scale.

DETAILED DESCRIPTION

The following detailed description is made with reference to the figures. Exemplary embodiments are described to illustrate the subject matter of the disclosure, not to limit its scope, which is defined by the appended claims.

Overview

In general, the present disclosure describes methods and systems for visually indicating a valid connection between two electrical connectors during an assembly of electrical components. To this end, a male connector and a female connector are configured to be mated to each other to accomplish the desired connection. Portions disposed on the male and the female connectors, overlapping and superimposing over each other, upon a connection, reproduce visually confirmable alterations, ensuring an alignment, and consequently validating a desired connection between the female connector and the male connector.

Exemplary Embodiments

Figure 1:
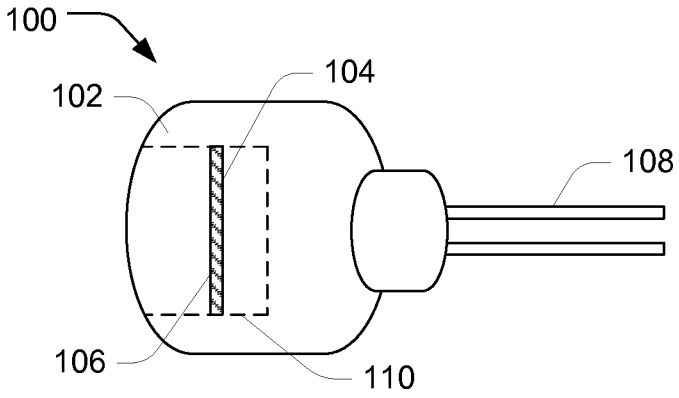
FIG. 1 is a schematic of a female connector, according to the embodiments of the present disclosure.
Figure 2:
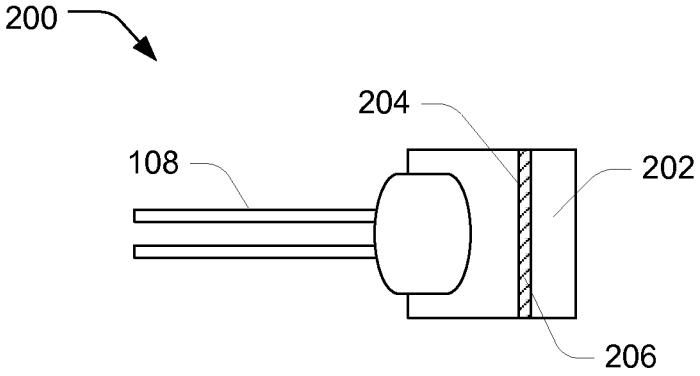
FIG. 2 is a schematic of a male connector, according to the embodiments of the present disclosure.

FIG. 1 illustrates an exemplary embodiment of a first connector, referred to as a female connector 100, configured to receive and accommodate a male connector, such as a male connector 200, shown in FIG. 2. Such accommodations are applicable during assembly and installation procedures, securing an electrical connection between two electrical components. The female connector 100, as depicted, is configured to include a first connector surface 102, and is further configured to include electrical wires or cabling 108. A rectangular strip of material, referred to as a transparent shape 104, is disposed on the first connector surface 102, as depicted. In addition, the transparent shape 104 is configured to include a particular color as well, referred to as a first connector color 106.

The color 106, disposed on the transparent shape 104, as disclosed above can be configured to be disposed through an ink or a paint job, or the color 106 could be completely disposed over the transparent shape 104 through an attachment of a molded strip of material having the color 106. Further, the color 106, as disposed, may also be configured on the transparent shape 104 in form of a dot, line, or any pattern as desired by a manufacturer.

In an embodiment, instead of having the color 106, the transparent shape 104 can be configured to include a predefined shape or a cut-out, which allows the transparent shape 104 to accommodate and align a portion of the male connector 200, such as a portion 204, as shown in FIG. 2, to be visible to an operator outside the female connector 100. Particularly, such visibility can be configured through the transparent shape 104. Further, the predefined shape or the cut-out can be in varied forms and structures, disposed for enabling connectivity, as mentioned above, and not limiting to any shape.

As stated above, a predefined shape or a cut-out, disposed on the first connector surface 102, will be accompanied by a similarly configured predefined shape on a corresponding male connector as well (discussed later), primarily allowing the two connectors to align with each other. Such alignments, in general, being viewable, indicate and validate a connection between the female connector 100 and a male connector, and such can be accomplished either through predefined shapes or through the color 106. Such alignments have been discussed further in the forthcoming disclosure.

In addition to the transparent shape 104, male connectors, such as the one shown in FIG. 2, are received by the female connector 100, in a slot 110, as shown. Accordingly, the slot 110 is configured in such a manner that an externally compatible and appropriately configured male connector, such as the one depicted in FIG. 2, seats itself precisely within the confines of the slot 110. Such a seating is particularly configured to include minimal play in connection, as well.

Furthermore, the female connector 100 includes a hard body shell made of materials such as high-grade plastic, stainless steel, bakelite, polymers of nylon, etc. Such materials, being stronger than conventional plastics, assist in enabling a secure and reliable seating of connections between electrical components for longer periods.

In conventional applications, female connectors, such as the female connector 100, includes one or more retaining clips or snapping features (not shown) that enhances and secures an accommodation to a male connector therein. Such features can optionally be included in the female connector 100, as well. More particularly, in such conventional applications, a tactile and/or audible feedback obtained through the snapping or the clipping feature enables an operator to validate a connection.

Other features, configurations, shapes, and designs, of the female connector 100, are known in the art, and thus will not be discussed further in the disclosure. Further, it is understood that alterations in shapes and designs apart from those shown and discussed for both the female connector 100 and the transparent shape 104, in the preferred embodiment are not limiting in any way.

On similar lines, a second connector, referred to as the male connector 200, shown in FIG. 2, also embodies a hard shell material, made out of high-grade plastic, stainless steel, bakelite, polymers of nylon, or the like. In particular, a stronger make of material allows stronger and reliable connections, as stated earlier. Further, the male connector 200 includes the cabling 108, similar to the one described for the female connector 100 in FIG. 1, and also includes an outer surface, referred to as the second connector surface 202, as shown. The second connector surface 202, as noted, includes a rectangular strip as well, similar to the transparent shape 104, shown in FIG. 1. Referred to as a portion 204, the rectangular strip is disposed on the second connector surface 202, as depicted. Moreover, the portion 204 is configured to include a particular color as well, different from the color 106, and thus referred to as second connector color 206.

The disposal of color 206, being similar to the color 106, can be built into the male connector 200 through a conventionally employed ink or a paint job. Alternatively, a molded strip of material, filled with the color 206, can be disposed as well, through known techniques.

Optionally, the portion 204 can be configured to include a predefined shape as well, similar to the predefined shape (or cut-out) discussed in connection with the female connector 100. In preferred embodiments, the predefined shapes of the portion 204 and the transparent shape 104 may include features that align the two shapes together, establishing a valid connection between the connectors, which is visible and confirmable through a human eye. Such predefined shapes can be rectangular or triangular in shape, or in any other shape that can be easily manufactured and disposed over the connectors through known techniques, aiding connection validations. It will be understood that validating a connection by mating two such predefined shapes may not require a color, such as the color 106 or color 206, to be disposed on either the transparent shape 104 or the portion 204, respectively. Further, such connections based shapes may include, for example, a circular protrusion disposed over a region on the male connector 200 to be encompassed by a similarly circular cut-out disposed on the female connector 100.

Likewise, the predefined shapes, as discussed, may not be configured similar or same for all embodiments, and can be configured different from each other, depending upon an availability of space on the connectors. Varied designs, layout, or different patterns and cut-outs, can be adapted in a manner to accomplish the desired result. As an example, for predefined shapes being dissimilar, the female connector 100 may include a squared slot to encompass a circular protrusion disposed on the male connector 200, replacing the transparent shape 104 and the portion 204, respectively. In such cases, the diameter of the circular protrusion can be kept similar to the dimension of the sides of the squared slot, enabling the slot to accomplish a complete and appropriate accommodation of the circular protrusion. Another example may be configured in such a way that enables accommodation of a similar 3D sign or a symbol, such as a company logo, etc., disposed on the male connector 200, to become accommodated within a cut-out disposed on the female connector 100, which in turn is adapted to encompass the outlines of the sign or symbol appropriately.

In another embodiment, the portion 204, can have no protrusions at all, but rather the portion can be a 2D figure, such as a company logo, name, etc., disposed on the second connector surface 202, that can be fully viewed through the transparent shape 104, when the two connectors 100 and 200 are aligned to each other. Such a state can also enable a visual detection, consequently indicating a valid connection. In addition, it is understood that certain embodiments may include validating a connection, through alignments as mentioned above, even when the transparent shape 104 and the portion 204 are having different shapes, structures, figures, etc.

In other less preferred embodiments, the transparent shape may be a cut-out that aligns with the outlines of the second connector color 206 disposed on the portion 204 of the male connector 200, aligning the two connectors 100 and 200 together, upon a connection. Such outlines of the second connector color 206 can be configured to be the outlines of a 2D figure, such as the one mentioned earlier.

In particular, such similar shapes or cut-outs being disposed on the surface of the female connector 100 and the male connector 200, respectively, may comply to confirm a secure connection between the two connectors by aligning and superimposing one predefined shape, design, cut-out, or figure, over the other. Similar alignments and superimpositions are enabled during a connection procedure that has been discussed further.

Furthermore, the male connector 200, as depicted, is configured to include outer confines compatible in relation to the inner confines of the slot 110 of the female connector 100. Other features, configurations, shapes, and designs, of the male connector 200, are known in the art, and thus will not be discussed further in the disclosure. It is understood that alterations in shapes and designs apart from those either shown or discussed for the preferred embodiments are not limiting in any way.

Manufacturing procedures for such connectors, having cut-outs or protrusions are well known in the art, and thus will not be discussed in the disclosure.

Figure 3:
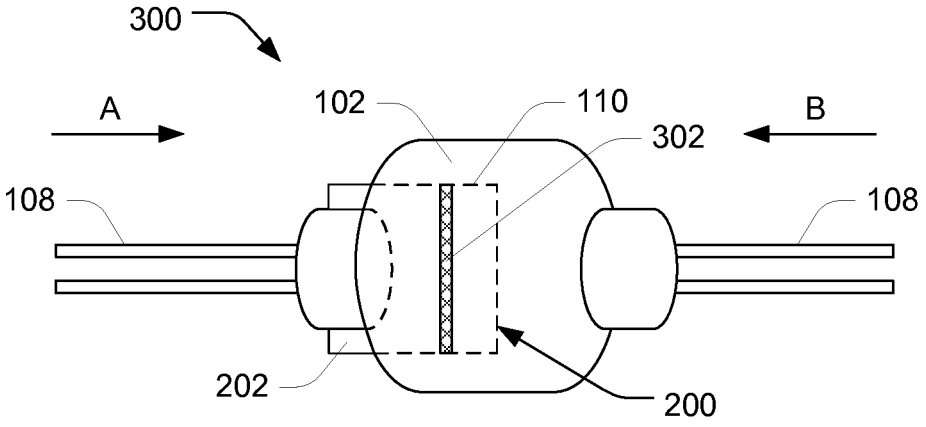
FIG. 3 is an exemplary application of the male connector mating with the female connector, according to the embodiments of the present disclosure.

FIG. 3 depicts a system 300 that combines the female connector 100 and the male connector 200 together.

As shown, the system 300 depicts the two connectors 100 and 200 in a state of mate and total engagement, with the male connector 200 being inserted into the slot 110 of the female connector 100. Further, arrow A and arrow B depict movements of the male connector 200 and female connector 100 to each other, respectively, during an assembly. As an embodiment depicted in the figure, the transparent shape 104 on the female connector 100 and the portion 204 on the male connector 200, are configured to include a color, opposed to the embodiment on having predefined shapes. Accordingly, the color 106 is disposed on the transparent shape 104, as shown, and the male connector 200 includes the color 206 disposed on the portion 204. Upon a mating operation through an operator, during assembly practices, the male connector 200 is inserted into the female connector 100, as shown through the arrow A. Such mating allows a superimposition and an interaction between the two colors 106 and 206 disposed over the transparent shape 104 and the portion 204, respectively, to produce an entirely new third color 302. The third color 302 is formed as a result of the respective wavelengths of the two colors 106 and 206, combining and becoming visible outside the female connector 100 to appear as a new color, entirely different from the two colors 106 and 206. Such observance of the third color 302 can particularly be observed visibly through the transparent shape 104, the transparent shape 104 being transparent or translucent in nature. Reproduction of the new third color 302, accordingly, enables an operator, responsible for mating the two connectors 100 and 200 together, to observe an appropriate mate visually, confirming an alignment and a valid connection between the two connectors 100 and 200.

As an example, if the color 106 disposed on the transparent shape 104 is yellow and the color 206 disposed over the portion 204 is blue, a mating of the two connectors 100 and 200 would consequently result in a green color. More particularly, when the shapes of the transparent shape 104 and the portion 204 are similar or same, the two shapes are consequently seen as one shape having the new third color 302. An eventual observance of the green color, thus, enables an operator to visually indicate and validate a connection. It is understood that the methodology as described above is possible with different color combinations as well.

Further, such validations can also be enabled through the transparent shape 104 and the portion 204, both having a combinational shape and a combinational color, with the preferred embodiments not limiting the shapes and colors in any way.

Through such a mechanism, connector operators are now able to reduce their insertion forces considerably, reducing fatigue levels and discomfort, because a tactile indication, through vibrations, clicking noises, etc., are no longer required for such applications. In addition, with the system 300, dependence over audible noises and operator feel is considerably reduced, which in conventional application were affected during an assembly operation because of random noises originating from the shop floor.

The specification has set out a number of specific exemplary embodiments, but those skilled in the art will understand that variations in these embodiments will naturally occur in the course of embodying the subject matter of the disclosure in specific implementations and environments. It will further be understood that such variation and others as well, fall within the scope of the disclosure. Neither those possible variations nor the specific examples set above are set out to limit the scope of the disclosure. Rather, the scope of claimed invention is defined solely by the claims set out below.

I claim:

1. A system for connecting two connectors to each other, the system comprising:

a first connector having a first connector surface, the first connector surface including a transparent shape therein, the transparent shape having a first connector color;

a second connector having a second connector surface, the second connector surface having a portion including a second connector color; and the second connector being configured to be inserted into the first connector, enabling a superimposition and alignment of the transparent shape with the portion, thereby visually indicating a valid connection between the two connectors when the superposition and alignment produces a third color.

2. The system of claim 1, wherein the first connecter is a female connector and the second connector is a male connector.

3. The system of claim 1, wherein the first connector and the second connector are electrical connectors.

4. The system of claim 1, wherein the first connector color and the second connector color are different from each other.

5. The system of claim 1, wherein the third color produced is different from the first connector color and the second connector color.

6. The system of claim 1, wherein the third color is configured to be visible through the transparent shape.

7. The system of claim 1, wherein the valid connection is visually indicated between the first connector and the second connector when the transparent shape, being configured in a predefined shape, superimposes and aligns with the portion of the second connector surface, also having a predefined shape.

8. A connecting system for electrical connectors, the system comprising:

a female connector configured to include a first connector surface, the first connector surface including a transparent shape therein, the transparent shape having a first connector color;

a male connector configured to include a second connector surface, the second connector surface having a portion including a second connector color; and the male connector configured to mate with the female connector, allowing a superimposition and alignment of the transparent shape with the portion, thereby visually indicating a valid connection between the two connectors when the superposition and alignment produces a third color.

9. The system of claim 8, wherein the first connector color and the second connector color are different from each other.

10. The system of claim 8, wherein the third color produced is different from the first connector color and the second connector color.

11. The system of claim 8, wherein the third color is configured to be visible through the transparent shape.

12. The system of claim 8, wherein the valid connection is visually indicated between the female connector and the male connector when the transparent shape, being configured in a predefined shape, superimposes and aligns with the portion of the second connector surface, also having a predefined shape.

13. A method for visually indicating a connection between two electrical connectors, the method comprising:

providing a first connector, having a first connector surface, and the first connector surface including a transparent shape of a predefined shape, the transparent shape having a first connector color;

providing a second connector, having a second connector surface, the second connector surface having a portion including a second connector color;

mating the second connector with the first connector; and indicating a valid connection visually when the transparent shape and the portion of the second connector surface are superimposed and aligned in relation to each other connectors, when the superposition and alignment produces a third color.

14. The method of claim 13, wherein the first connector is a female connector and the second connector is a male connector.

15. The method of claim 13, wherein the first connector color, the second connector color and the third color are all different from each other.

16. The method of claim 13, wherein the third color is configured to be visible through the transparent shape.

17. The method of claim 13, wherein the valid connection is visually indicated between the first connector and the second connector when the transparent shape, being configured in a predefined shape, superimposes and aligns with the portion of the second connector surface, also having a predefined shape.

* * * * *